United States Patent [19]

Wolf

[11] Patent Number: 4,562,388

[45] Date of Patent: Dec. 31, 1985

[54] WINDUP-CONTROL SYSTEM FOR TEXTILE MACHINERY

[75] Inventor: Horst Wolf, Albershausen, Fed. Rep. of Germany

[73] Assignee: Zinser Textilmaschinen GmbH, Ebersbach, Fed. Rep. of Germany

[21] Appl. No.: 590,471

[22] Filed: Mar. 16, 1984

[30] Foreign Application Priority Data

Mar. 18, 1983 [DE] Fed. Rep. of Germany ..... 3309789

[51] Int. Cl.[4] ..... H02P 1/54

[52] U.S. Cl. ..... 318/301; 318/329; 318/49; 318/59; 318/66

[58] Field of Search ..... 318/49, 51, 53, 59, 318/66, 67, 69, 77, 85, 301, 305, 310, 329

[56] References Cited

U.S. PATENT DOCUMENTS

| | | | |
|---|---|---|---|
| 2,885,616 | 5/1959 | Anger et al. | 318/85 |
| 3,064,173 | 11/1962 | Breen et al. | 318/329 X |
| 3,447,050 | 5/1969 | Geis | 318/67 |
| 3,465,223 | 9/1969 | Mears | 318/329 X |
| 3,678,351 | 7/1972 | Shemanske | 318/329 X |
| 3,838,321 | 9/1974 | Damm et al. | 318/66 |
| 4,174,237 | 11/1979 | Hemming, Jr. et al. | 318/67 X |
| 4,270,072 | 5/1981 | Weber | 318/59 X |
| 4,289,997 | 9/1981 | Jung et al. | 318/49 X |
| 4,334,175 | 6/1982 | Tanaka et al. | 318/66 |

*Primary Examiner*—William M. Shoop, Jr.
*Assistant Examiner*—Shik Luen Paul Ip
*Attorney, Agent, or Firm*—Karl F. Ross; Herbert Dubno

[57] ABSTRACT

In a ring spinning or other textile machine with a multiplicity of thread-winding stations each including one or more variable-speed motors, a central controller supplies periodic or continuous timing signals to respective speed setters of all stations for a predetermined progressive speed change of the associated variable-speed motors. In a specific embodiment, the timing signals are recurrent pulses for the advance of identical programs of the local speed setters whereby the several stations will follow the same routine but with possible relative staggering in time, taking individual delays due to thread breaks or the like into account.

5 Claims, 4 Drawing Figures

WINDUP-CONTROL SYSTEM FOR TEXTILE MACHINERY

FIELD OF THE INVENTION

My present invention relates to ring spinning or other textile machines wherein a multiplicity of more or less identical thread-winding stations are each provided with one or more variable-speed motors for driving spindles of take-up bobbins, supply spools and possibly other devices whose speeds must be correlated with one another.

BACKGROUND OF THE INVENTION

In such machines it is known that, in the course of a thread-winding operation, the speeds of the components involved in such an operation may have to be progressively changed (increased and/or decreased) in order to preserve a certain quality of the product. Thus, for example, the maintenance of a constant rate of twist in the thread being wound up requires that an invariable ratio be established between the rate at which the thread is fed to a traveler from a supply spool driven by an upstream motor and the rate at which the thread is being picked up by the aforestated take-up bobbin on a spindle driven by a downstream motor. This may call for a progressive acceleration of rotation of the supply spool, whose diameter continuously decreases, accompanied by a progressive deceleration of the spindle carrying the take-up bobbin whose diameter continuously increases. In some instances, though, it may be necessary to accelerate the spindle rotation as well as the turning of the supply spool in order to keep the ballooning thread under a certain tension; this is true, for example, with machinery for the winding of glass fibers as disclosed in commonly owned U.S. patent application Ser. No. 480,868 filed Mar. 31, 1983 by Gerd Hausner et al.

Situations also exist, however, where the speed ratio between an upstream motor and a downstream motor of a given winding station may be left approximately constant, e.g. where the thread is being supplied by a tension frame and the variation in the diameter of the take-up bobbin results in only insignificant changes of the twist rate. See, in this connection, my copending application Ser. No. 589,408 filed on Mar. 14, 1984.

There are, of course, several known ways of modulating a motor speed in a programmed manner. French patent No. 1,456,011, for example, discloses two supply networks of different frequencies for the alternate energization of individual a-c motors along with a timer switching each motor from one network to the other and vice versa in a predetermined sequence. Such a system, however, is limited to two discrete motor speeds. German printed specification No. 1,117,716 proposes the use of a main supply network of fixed frequency and an ancillary supply network whose frequency is increasable from a low value to that of the main network, the ancillary network being connectable to the individual motors in a startup period to bring them up to operating speed. This system does not enable a progressive speed modification during a normal operating period.

OBJECTS OF THE INVENTION

The general object of my present invention is to provide a simple circuit arrangement for enabling simultaneous progressive modification of the operating speed of one or more motors at each thread-winding station in a preprogrammed manner identical for all stations but performed separately in each station.

A more particular object is to provide a circuit arrangement of this character which lets each station go through the same routine of speed variation but not necessarily at the same time whereby, if the routine of one station is interrupted by a thread break, for example, that routine can subsequently be resumed at the stage of interruption while the routines of all other stations are unaffected.

SUMMARY OF THE INVENTION

In accordance with my present invention, a textile machine with a multiplicity of thread-winding stations as discussed above is provided with an individual speed setter at each station for altering the speed of the respective variable-speed motor or motors in a predetermined manner, these speed setters being responsive to timing signals from a central controller common to all stations by which they are jointly actuated.

In a general case, in which the possibility of an unforeseen interruption of the routine at one or more stations is not taken into account, the timing signal emitted by the central controller may be progressively variable (e.g. in amplitude, pulse frequency or pulse width) so as to indicate to all speed setters simultaneously the speed level to be established as a given instant. If each speed setter is to act upon a pair of motors whose speed ratio must be progressively changed, a central programmer may deliver to the several speed setters an additional signal indicating the new value of the speed ratio to be established at each point of the program so that the speed setter modifies, for example, the speed of the downstream motor in response to the timing signal from the central controller and changes the speed of the other (upstream) motor in light of the speed-ratio signal received from the central programmer.

According to a preferred embodiment of my invention, however, the timing signals delivered by the central controller are simply a series of pulses of constant cadence or repetition frequency which advance the local program of each speed setter in an identical manner without regard for the current status of that program in steady-state operation whereby all stations will again go through the same routine but, possibly, in relatively time-staggered relationship. In the system last described, the presence of a memory in each local programmer enables the storage of an indication of the stage in its routine at which the thread-winding operation is unexpectedly interrupted so that the contents of that memory can be subsequently utilized to restart the routine at the point at which it was broken off.

BRIEF DESCRIPTION OF THE DRAWING

The above and other features of my invention will now be described in detail with reference to the accompanying drawing in which.

SPECIFIC DESCRIPTION

Figure 1:
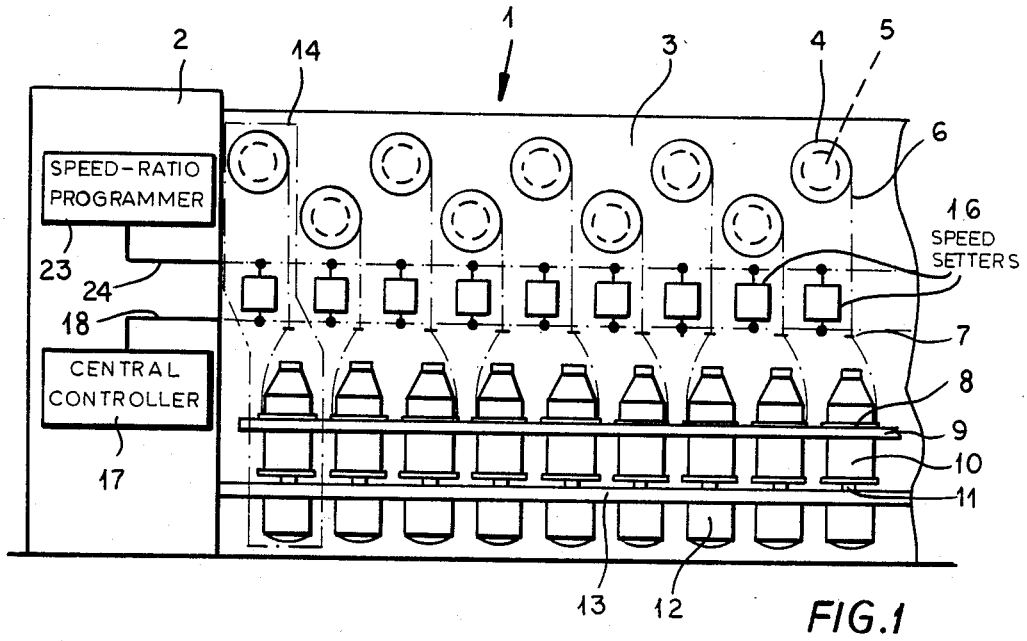
FIG. 1 is a somewhat diagrammatic elevational view of part of a ring spinning machine embodying a windup-control system according to my invention.

FIG. 1 shows part of a ring spinning or twisting machine 1, e.g. for glass fibers, comprising a central station 2 which includes conventional power-supply and control equipment not further illustrated. A frame 3 carries a multiplicity of supply spools 4 each provided with an individual drive motor 5 of the 3-phase type and as many spindles 11 which are journaled in a stationary rail 13 and are driven by respective motors 12 generally similar to motors 5. Threads 6 payed out from each supply spool 4 pass through a respective guiding eye 7 and a traveler (not specifically designated) on a traveler ring 8 which is lodged in a vertically displaceable ring rail 9. Spindles 11, carrying take-up bobbins 10, pass through the respective traveler ring 8 in order to be loaded with the incoming threads 6. The vertical reciprocation of rail 9 is performed, in a manner well known per se, by a nonillustrated motor inside station 2. Each combination of spool 4, motor 5, eye 7, traveler ring 8, spindle 11 and motor 12 constitutes a thread-winding station 14 which is further provided with an individual speed setter 16 coupled to motors 5 and 12 as more fully described hereinafter.

Station 2 is shown provided with a central controller 17 connected via a line 18 to all speed setters 16 in parallel. FIG. 1 additionally shows a speed-ratio programmer 23 likewise connected, by a common line 24, to all speed setters 16 in parallel.

In the machine of FIG. 1 it is assumed that all working stations 14 operate precisely in step with one another. Thus, speed setters 16 impart concurrent speed increments or decrements to the associated upstream and downstream motors 5 and 12 under the control of timing signals from circuit 17 on line 18 and ratio-modifying signals on line 24, as described above. By way of example, a full thread-winding operation may last for two to eight hours during which central controller 17 emits a pulse every two to five minutes on line 18, thus a total of about 60 to 100 pulses over the entire operating period. Each pulse may cause all the controlled speed setters 16 to increment (or decrement) the rotary speed of, say, the associated motor 12 by a predetermined numerical value, e.g. of 50 rpm. In this case, which also constitutes the mode of operation of controller 17 assumed hereinafter, the timing pulses on line 18 need not differ from one another in amplitude, pulse width or recurrence rate; such modulation, however, could be used to read out predetermined speed levels from a microprogramme associated with each speed setter 16 so that the speeds of all motors 5 and the speeds of all motors 12 always have identical magnitudes.

Figure 2:
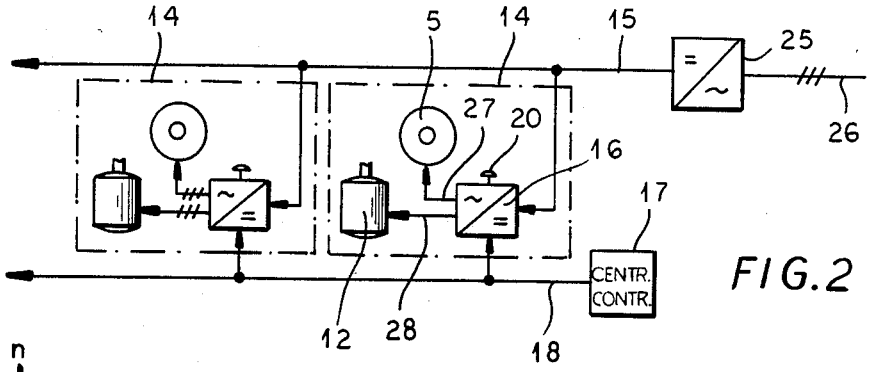
FIG. 2 is a block diagram giving details of several thread-winding stations of the machine shown in FIG. 1.

FIG. 2 shows several winding stations 14 in greater detail. A line 15 common to all stations 14 is connected to a 3-phase power network 26 through an ac/dc converter or rectifier 25 so as to carry direct current. Each speed setter 16 is here shown to include a dc/ac converter operating in the 4-quadrant mode to drive the associated motors 5 and 12 which may be of the synchronous type. Actually, each speed setter includes two such converters for setting the operating speeds of the associated motors. The output frequencies of the 3-phase currents delivered to motors 5 and 12 over respective lines 27 and 28 are varied, in a manner well known in the art, by commands successively read out from a program store of the corresponding microprogrammer which has not been illustrated but whose operation will be described hereinafter with reference to FIG. 4. With the use of such ac/dc and dc/ac converters, a slowing of motors 5 and 12 in the event of programmed deceleration—or upon cutoff at the end of a thread-winding operation—will feed back energy to the power network 26 with resulting energy saving.

When the stored microprogram of each speed setter 16 includes specific values for the respective speeds of motors 5 and 12 to be read out each time the local microprogrammer is stepped by a control pulse on line 18, the speed-ratio programmer 23 of FIG. 1 will not be needed. Thus, each speed setter 16 is shown provided with a start button 20 which can be manually operated to put the respective microprogram into effect after a fresh take-up bobbin has been placed on the corresponding spindle 11 and has been wound with an end of the thread 6 coming from the associated supply spool 4. Such a microprogram has been schematically illustrated in a graph 19 of FIG. 3 and, as shown there, is divided into three periods, namely a startup period $t_1$, an operating period $t_2$ and a cutoff period $t_3$; period $t_2$ has been greatly foreshortened with reference to the other two periods.

Let us assume that graph 19, by which speed n is plotted against time t, pertains to upstream motor 5 of the winding station 14 shown at right in FIG. 2. In an initial part of the program, coinciding with period $t_1$, this motor is accelerated to a first speed level $n_1$ after which the program enters its main operating period $t_2$. During the latter period, the microprogrammer is progressively stepped by pulses arriving on line 18 to increase the speed of that motor by consecutive increments $\Delta n$, these pulses recurring at constant intervals $\Delta t$. After the prescribed winding period, the motor 5 has reached a second speed level $n_2$ whereupon the microprogrammer switches to cutoff period $t_3$ in which the motor returns to standstill.

Figure 3:
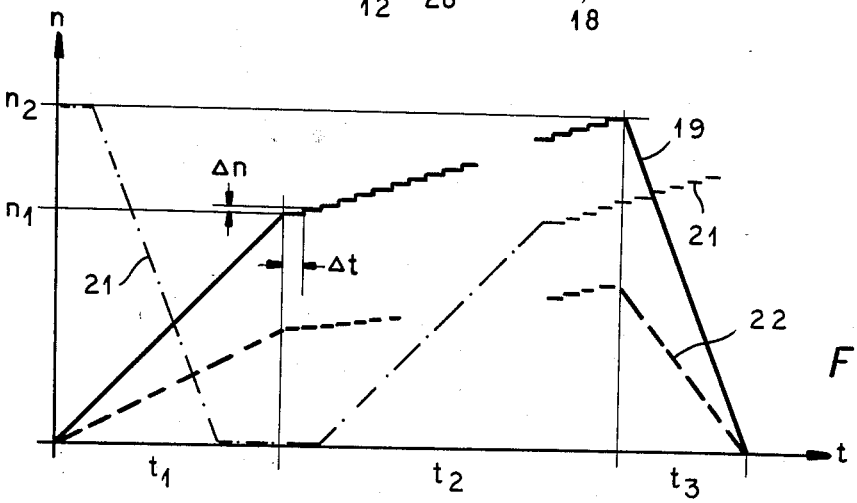
FIG. 3 is a set of graphs pertaining to the operations of a control system according to my invention.

Another graph 22 in FIG. 3 shows the concurrent speed changes of the associated downstream motor 12 which, in this instance, generally parallel those of motor 5 but with lower increments. The two motors reach their respective first and second speed levels and also return to standstill simultaneously; this may be accomplished with the aid of tachometers sensing the instantaneous speeds of the two motors and working into a calculator maintaining a prescribed ratio during startup and cutoff as disclosed in my above-identified copending application Ser. No. 589,408.

FIG. 3 further shows a graph 21 which is identical with graph 19 but temporally offset with reference thereto, pertaining for example to the upstream motor of the left-hand winding station 14 shown in FIG. 2. It will thus be seen that the two motors 5 operate according to identical routines but at different times.

Figure 4:
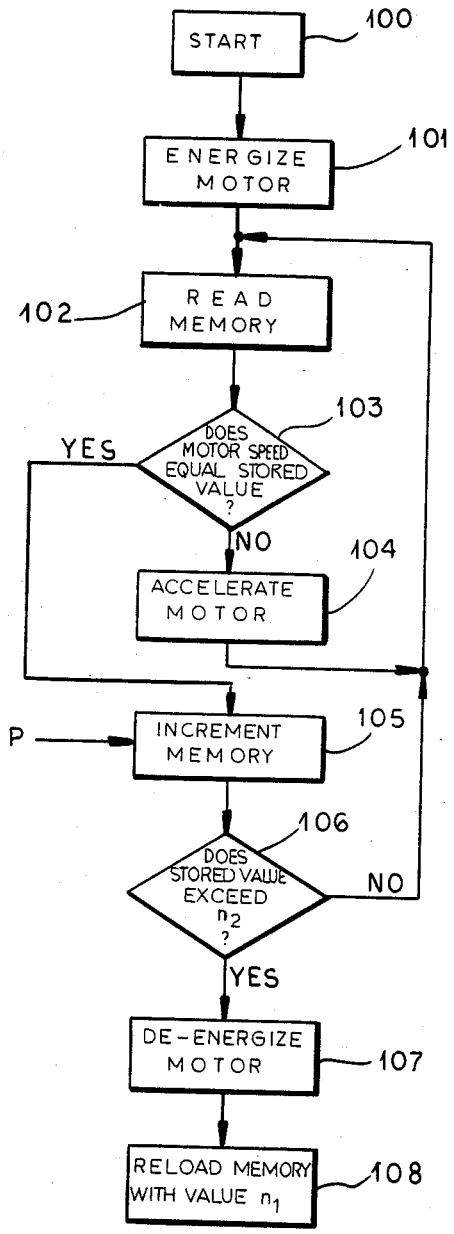
FIG. 4 is a flow chart pertaining to a local program executed at each thread-winding station.

FIG. 4 shows by way of example a microprogram for a given speed setter 16 which is started at a step 100 by the depression of pushbutton 20. This results in the energization of the motor being considered (step 101) whereupon the associated memory is read in a step 102. There follows an inquiry 103 to determine whether or not the motor has reached the speed level stored in the memory at that time; generally, unless the routine had been interrupted prematurely by a thread break or the like, the stored value will equal the initial level $n_1$. If the level has not yet been reached, the motor is accelerated in a step 104 whereupon step 102 is re-entered. When inquiry 103 yields a positive response, the contents of the memory are incremented (e.g. to $n_1+\Delta n$) in a step 105 in response to the next timing pulse P arriving over line 18. After the storage of a new speed level in the memory, another inquiry 106 determines whether the final speed level $n_2$ is or is not exceeded by the new value. If level $n_2$ has not yet been surpassed, the program returns to step 102 as many times as are necessary to reach the motor speed $n_2$. When this occurs, the motor is de-energized in a step 107 and the memory is reloaded with the initial value $n_1$ in a step 108. This terminates the routine for a thread-winding operation.

It will be apparent that a premature interruption of the program will cause its resumption, after another actuation of start button 20, at the speed level at which the routine had been stopped.

It will also be obvious that decrementation instead of incrementation will occur during operating period $t_2$ if the first level $n_1$ is higher than the second level $n_2$. The steps described with reference to FIG. 4 will as well apply—albeit with different numerical values—to the microprogram concerning the downstream motor 12 (graph 22). Alternatively, the speed values read out for motor 5 from the memory may be modified in a speed regulator, also controlled by the microprogrammer, before being fed to the downstream motor 12. Such a speed regulator has been shown, for example, in the above-identified commonly owned application of Hausner et al. As further shown in that application, a thread-length counter responsive to the advance of thread 6 may be used to ascertain the existence of a break in order to interrupt the microprogram.

Textile machines to which my invention is applicable include not only ring spinners and twisters but also draw-spinning, draw-twisting and twining machines, for example.

I claim:

1. In a textile machine having a multiplicity of thread-winding stations each including a pair of variable speed motors adapted to operate at predetermined speed ratios and with different speeds, the combination therewith of:

an individual speed setter at each of said stations operatively connected to both of the motos thereof for setting the respective speeds of said motors establishing ratios of the speeds of said motors, said speed setters each being provided with a program for stepping the respective motors through a progressive speed increase sequence from a respective predetermined first speed level to a respective predetermined second speed level, said levels and sequence being common to all of said stations and the respective motors thereof; and a central controller common to all said stations and connected to all of said setters for emitting timing signals for simultaneously stepping all of said setters in which the motors are between the respective first and second speed levels, to increment the respective sequences at each station individually between said levels whereby said stations can commence the respective sequences at different times.

2. The combination defined in claim 1 wherein said variable speed motors are all of a three-phase type and each of said speed setters includes a dc/ac converter of variable output frequency energizing the respective motors of the respective station.

3. The combination defined in claim 1 wherein said programmers include memories for individually storing an indication of a stage in a routine in which the speeds of the motors of a respective station are controlled at which a thread-winding operation is interrupted to thereby enable subsequent resumption of the routine at said stage.

4. The combination defined in claim 1 wherein said programmers are manually restartable after an interruption in a thread-winding operation.

5. In a textile machine having a multiplicity of thread-winding stations each including a variable-speed motor adapted to operate with different speeds, the combination therewith of:

an individual speed setter at each of said stations operatively connected to the motor thereof for setting the speed of said motor, said speed setters each being provided with a programmer stepping the respective motor through a progressive speed increase sequence in increments from a first predetermined speed level to a second predetermined speed level, said sequence and said levels being common for all said stations; and a central controller common to all said stations and connected to all of said speed setters and emitting timing signals for the simultaneous stepping of all of said setters to increment the respective sequences between said levels at each station whereby said stations can commence the respective sequences at different times.

* * * * *